United States Patent [19]

Yoshikawa et al.

[11] Patent Number: 4,700,723

[45] Date of Patent: Oct. 20, 1987

[54] TOBACCO FILTER AND FIBROUS ION EXCHANGE RESIN

[75] Inventors: Seiichi Yoshikawa, Shiga; Toshio Yoshioka; Masaharu Shimamura, both of Otsu, all of Japan

[73] Assignee: Toray Industries, Inc., Tokyo, Japan

[21] Appl. No.: 572,382

[22] Filed: Jan. 20, 1984

[30] Foreign Application Priority Data

Mar. 10, 1983 [JP] Japan ..... 58-39755

[51] Int. Cl.[4] ..... A24D 3/12

[52] U.S. Cl. ..... 131/334; 131/341; 131/342

[58] Field of Search ..... 131/334

[56] References Cited

U.S. PATENT DOCUMENTS

| | | | |
|---|---|---|---|
| 2,739,598 | 3/1956 | Eirich | 131/334 |
| 3,887,730 | 6/1975 | Rainer et al. | 427/244 |
| 4,292,984 | 10/1981 | Sawada et al. | 131/345 |
| 4,300,577 | 11/1981 | Horsewell et al. | 131/334 |

FOREIGN PATENT DOCUMENTS

| | | | |
|---|---|---|---|
| 1023918 | 3/1966 | United Kingdom | 131/334 |

*Primary Examiner*—V. Millin

*Attorney, Agent, or Firm*—Wegner & Bretschneider

[57] ABSTRACT

A filter for tobacco smoke containing a fibrous ion exchange resin and a fibrous ion exchange resin wherein at least a part of the fiber is fibrillated or split for use in making the filter is disclosed. The filter efficiently removes substances harmful to the human body, e.g., ionic, polar, carcinogenic, and mutagenic substances, and nicotine and tar from tobacco smoke.

18 Claims, 16 Drawing Figures

TOBACCO FILTER AND FIBROUS ION EXCHANGE RESIN

FIELD OF THE INVENTION

The present invention relates to tobacco filters and a special type of fibrous ion exchange resins. The tobacco filters of the present invention selectively reduce the levels of ionic, polar, and mutagenic components as well as those of tar and nicotine in tobacco smoke. The fibrous ion exchange resins of the present invention are suitable for use in the tobacco filters of the present invention and also for the production of ion exchange papers for other filter uses.

BACKGROUND OF THE INVENTION

The smoking of tobacco has been widespread throughout the world for many years. However, it has recently been shown that tobacco smoke is harmful not only to habitual smokers, but also to nonsmokers. Thus, there have more recently been considerable concern about the health hazards caused by tobacco smoke.

Tobacco smoke contains thousands of components of various kinds, many of which are harmful to the human body and some of which are shown to be carcinogenic and/or mutagenic.

In order to remove and reduce these toxic components from tobacco smoke, there have been proposed filters consisting of cellulose acetate fiber and those containing activated carbon. These filters reduce harmful components of tobacco smoke to a certain extent, but the efficiency is still unsatisfactory. For example, these filters do not selectively adsorb ionic or polar components of tobacco smoke, many of which are highly harmful.

Activated carbon is frequently used in the form of fine grains and in combination with cellulose acetate fiber. These fine grains of activated carbon readily aggregate with each other due to tar formed during smoking and rapidly lose their surface activity. Moreover, these grains are difficult to be mixed uniformly with cellulose acetate fiber and readily separate and fall off from the fiber. Therefore, it is difficult to handle grains in filter production and to disperse grains uniformly in the filter. Accordingly, ideal contact of smoke with these grains in conventional tobacco filters cannot be achieved. Similar problems arise even when ion exchange resin grains are used in place of activated carbon grains. Thus, these granular substances cannot be made effective enough to reduce the levels of toxic components in tobacco smoke.

It is difficult to prepare a sheet such as a paper for other filter uses from the granular substances. Though it has been proposed to use a layer of powdered ion exchange resin as pre-coat filter in a pure water producing process, such filters are very fragile, break too easily, and inevitably cause a large pressure drop during filtration.

SUMMARY OF THE INVENTION

In order to overcome these disadvantages of the existing tobacco filters and ion exchange resins, we have sought to provide tobacco filters capable of greatly adsorbing or removing toxic components of tobacco smoke, especially ionic and polar components which are highly toxic. As a result we have discovered that fibrous ion exchange resins can solve all these problems attributable to the disadvantages of the existing tobacco filters and ion exchange resins described above and also that fibrous ion exchange resins have an excellent capability to remove the harmful substances contained in tobacco smoke.

Furthermore, this invention provides fibrous ion exchange resins that can readily adsorb not only ions, but also materials of biological interest, such as proteins, enzymes, viruses, bacteria, cells, and micro-organisms. In addition, the fibrous ion exchange resins also can adsorb a very large amount of an ion or a colloidal material at a high flow rate without any large pressure drop across the filter. Another object of this invention is to provide excellent ion exchange papers. In another aspect, the present invention provides fibrous ion exchange resins having an islands-in-sea construction, in which an ion exchangeable sea component is reinforced with an island component. The fibrous ion exchange resins are, at least partially, fibrillated or split.

By employing such a technical constitution, the present invention makes it possible to prepare tobacco filters that can remove mutagenic and other toxic components in tobacco smoke very efficiently. The present invention also makes it possible to produce economically tobacco filters of excellent and reproducible uniform quality.

In addition, the fibrous ion exchange resins of the present invention can be readily dispersed in water and are readily entangled each other because of their fibrillated structure. Thus, the present invention also makes it possible to supply fibers that are particularly suitable for production of various fiber products, such as a blended yarn and a non-woven, and especially suitable for production of papers and sheets.

A: Trapping portion

Figure 1:
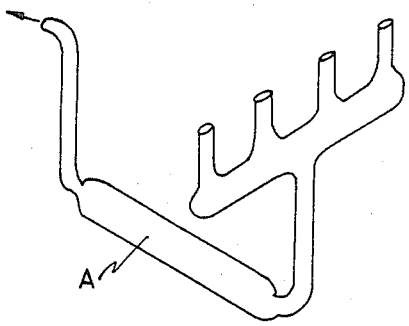
FIG. 1 shows a smoking apparatus in which smoke is sucked in the arrow direction.

B: Peak due to substances of about 10 carbon atoms

C: Peak due to nicotine

D: Peak due to substances of about 25 carbon atoms

E: Peak due to substances of about 32 carbon atoms

F: UV-spectrum of 1N NaOH aqueous solution

G: Sheet consisting the ion exchange fiber of the present invention

H: Filter component made of a non-ion exchange fiber

Arrow mark: Suction direction of smoke

Solid line (a): UV spectra of non-ionic (non-polar) substances

Broken line (b): UV spectra of ionic (polar) substances

Solid line (c): A smoke condensate obtained from cigarettes with the filter of the present invention Solid line (d): A smoke condensate obtained from the commercially available tobacco used for a comparative example Solid line (e): The ethanol extract of the tobacco filter used for the smoking (Residue X)

Solid line (f): The alkaline ethanol extract of the tobacco fiber used for the smoking (Residue Y)

DETAILED DESCRIPTION OF THE INVENTION

The fibrous ion exchange resins involved in the present invention comprise ion exchangers such as polystyrene, polyvinyl alcohol, polyacryl, polyamide, polyphenol, and cellulose types. Among them, poly-monovinyl aromatics are preferable and especially polystyrene type polymers are most preferred for their excellent chemical stability. Polystyrene type polymers which are preferably used include homopolymers of styrene alpha-methylstyrene, vinyltoluene, vinylxylene, chloromethyl styrene, etc., copolymers of at least two types thereof, copolymers with other inert monomers, and blends of these polymers.

The ion exchangers are featured by their ion exchange ability, which is given by introducing cation or anion exchange groups, or chelating groups to polymers.

The cation exchange groups include strongly acidic sulfonic acid group, medially acidic phosphonic acid group, weakly acidic carboxylic acid group etc.

The anion exchange groups include strongly basic quaternary ammonium group, weakly basic primary, secondary, amino groups etc. Examples of chelate groups are aminocarboxylic acid groups such as iminodiacetic acid group and iminodipropionic acid group, amidoxime group, aminophosphoric acid group, polyamine group, pyridine group, and dithiocarbamic acid group. These ion exchange groups should be present at a concentration of at least 0.1 meq/g on the basis of dry weight of an ion exchanger, preferably at least 0.5 meq/g, and most preferably in the range of 1.0 to 10 meq/g. The smaller content of an ion exchange group is the less desirable for obtaining a higher ion exchange performance. However, its introduction in excess of 10 meq/g is technically difficult and impractical.

Ion exchangers containing one of the above-mentioned ion exchange groups are readily dissolved in water. Accordingly, these ion exchangers are usually insolubilized by means of cross-linking and by other means to the extent that they are insoluble enough at least in water. There are some exceptions, such as cellulose, which remain insoluble even when they contain one of the ion exchange groups described above.

The fibrous ion exchange resins involved in the present invention can be used as tobacco filters, mainly as cigarette filters. They also can be used as an accessory tobacco filter for smoking appliances such as tobacco pipes and Japanese pipes.

The ion exchange fibers are compounded uniformly covering a plane vertical to the inhalation direction of the filter when smoking. The tobacco filters can be prepared using one of the ion exchange fibers alone or in combination with other filter materials such as cellulose acetate fiber and activated carbon. The above-mentioned fibrous ion exchange resins can be uniformly mixed and compounded with the existing cellulose acetate fiber. It is also possible that a filter segment made of one of the fibrous ion exchange resins alone is sandwiched with two separate filter segments made of the conventional cellulose acetate fiber.

The amount (dry weight standard) of a fibrous ion exchange resin used in the tobacco filter of the present invention should be at least 0.1 mg/g of the tobacco component, commonly 0.1 to 200 mg/g, preferably 0.5 to 180 mg/g, and more preferably 1 to 150 mg/g. When the amount of the fibrous ion exchange resin in the filter is too small, the objective of the present invention cannot be achieved due to the decreased capacity of removing toxic components of tobacco smoke. On the other hand, when too much fibrous ion exchange resin is used, the taste of the tobacco smoke is too mild. Most of habitual smokers would not be satisfied with such a too mild taste although this depends on individuals. Thus, the amount of the fibrous ion exchange resins used in a tobacco filter should be in the above-stated ranges.

Figure 14:
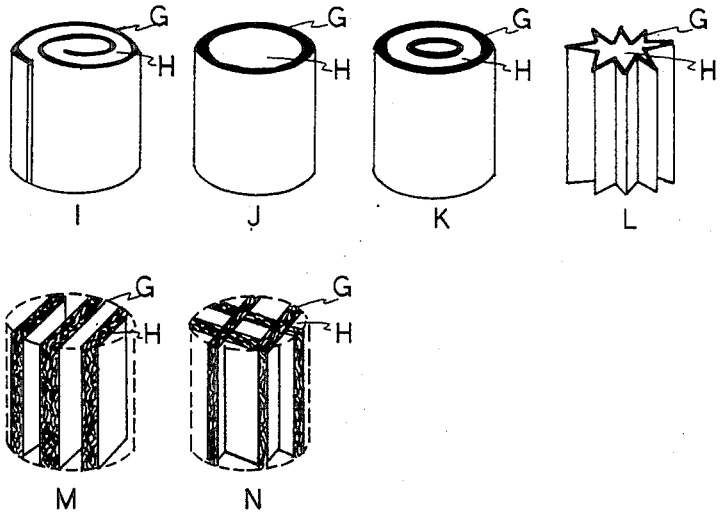
FIG. 14 shows the constructions of the tobacco filters of the present invention and FIG. 15 shows an example of the tobacco pipes, to which one of the tobacco filters shown in FIG. 14 is applied.
Figure 15:
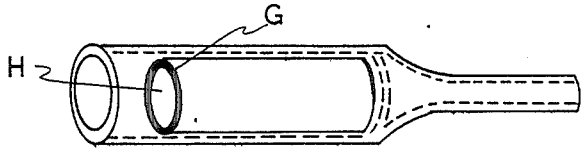

The tobacco filters of the present invention can be applied to commercially available tobacco pipes and Japanese tobacco pipes. FIG. 14 illustrates the constructions of some of the tobacco filters of the present invention. The tobacco filters consist of an ion exchange fiber sheet and a non-ion exchangeable filter material. FIG. 14 shows examples (I, J, K, L, M, and N) of the constructions of the tobacco filters of the present invention. However, the constructions of the tobacco filter of the present invention are not restricted in these examples. FIG. 15 shows an example of tobacco pipes to which one of the tobacco filters shown in FIG. 14 is attached. In the tobacco pipe, the tobacco filter is placed in a position parallel to the suction direction. A loose contact of G shown in FIG. 15 with the inner wall of the pipe and existence of a space at the position of H shown in FIG. 15 may not cause a serious problem. However, in order to obtain the highest efficiency, a tight contact of the tobacco filter with the inner wall of the pipe and use of a non-ion exchangeable fiber to fill the space of H shown in FIG. 15 are, of course, preferable. The construction is also preferable, in which the tobacco filter is sandwiched with two separate conventional non-ion exchangeable filter segments.

The form of the fibrous ion exchange resins of the present invention include forms such as cut-fibers and staple fibers, yarn forms such as filaments, knitted fabrics, woven fabrics, knitted cords, and braids, and texture forms such as papers, sheets, and non-woven fabrics. The present invention also includes ion exchangers in any other fiber forms. The above-mentioned ion exchange fibers have a fineness of about 0.1 to 500 d. The ion exchange fibers with a fineness of 1 to 50 d are especially preferred from the viewpoints of both mechanical strength and practical use. The cross sections of the fibers includes round shapes and non-round shapes, the latter being preferred because of their large surface area.

The moisture content of the fibrous ion exchange resins is an important factor modulating their capacity of adsorbing and removing toxic components of tobacco smoke. When the fibrous ion exchange resins are extremely dry, their ability to adsorb and remove toxic components of tobacco smoke is very poor. The moisture content remarkably affects the capacity of the ion exchange fibers to trap, especially, ionic components of tobacco smoke. Therefore, the moisture content of the fibers should be between 0.5 and 80%, preferably between 1.0 and 50%, and more preferably between 2 and 30%. When the moisture content of the fibers is too high, the fibers become glued to each other and stronger inhaling force is needed when smoking. And at the same time the taste of tobacco becomes too faint, which is undesirable for most habitual smokers.

Characteristics of the fibrous ion exchange resins of the present invention are preferably brought by the ion exchange fibers reinforced with a polymer. The employment of such a construction results in the enhancement of both the mechanical strength and flexibility of the fibers and gives excellent results during the subsequent process that the fibers are shaped into a tobacco filter.

Fibers consisting of an ion exchange polymer (A) and a reinforcing polymer (B) include: first, mixed (dope blended) spun fibers consisting of (A) and (B); second, core-sheath type (either concentric or eccentric type) composite fibers containing the sheath component consisting mainly of (A) and the core component consisting mainly of (B); third, islands-in-sea (multi-core) type composite fibers in which the island component consisting mainly of (B) is plurally dispersed in the sea component consisting mainly of (A) and these are arranged parallel in the axial direction. Among them, the islands-in-sea type composite fibers are preferably used because of their excellent physical properties and convenience in handling.

The number of islands in islands-in-sea type composite fibers is preferably at least 2, but not more than 300, although it can not be specified to a particular number.

Examples of the reinforcing polymers involved in the present invention are homopolymers such as polyesters, polyamides, polyolefins, etc., copolymers thereof, and blends thereof. Among them, especially polyolefins are most preferred for their outstanding chemical stability. The polyolefins include polypropylene, polyethylene, poly-3-methylbutene-1, poly-4-methylpentene-1, etc., and blends thereof.

The ratio of the ion exchange polymer (A) to the reinforcing polymer (B) in a mixed or composite fiber of the present invention is (A)/(B)=95/5 to 10/90, preferably 80/20 to 20/80, and especially 70/30 to 30/70. Too low contents of (B) are undesirable, taking into consideration the mechanical strength and flexibility of the fibers. On the contrary, when the content is too high, it is undesirable since the ion exchange and adsorption abilities are lowered.

Partial fibrillation and/or partial splitting of the ion exchange fibers result in further improvement in their ability to adsorb harmful components of tobacco smoke and assure smooth smoking due to negligible suction resistance.

The fibrous ion exchange resin used for the tobacco filters of the present invention includes fibrous ion exchange resins containing a cation exchange group, an anion exchange group, and a chelating group. A cation exchange fiber is compounded as at least one component of a tobacco filter of the present invention. An example of the ion exchange groups of the cation exchange fibers of the present invention is sulfonic acid group which is available as H type, an alkali metal type such as Li, K or Na type, an alkali earth metal type such as Ca or Ba type, or a transition metal type such as Cu, Fe or Co type. Especially, the H type is preferred for its ability to adsorb harmful substances contained in tobacco smoke.

The fibrous ion exchange resins of the present invention have a islands-in-sea construction and are at least partially fibrillated. Fibrillation is caused by breaking of the sea component. Fibrillation can be developed in a form of either filaments or staple fibers. Fibrillated fibers can be used for various fiber products with blending during spinning, knitting, weaving and non-woven sheet making. Especially, fibrillated fibers exhibit excellent stability on dispersion and suitable for paper making. Thus, the fibrous ion exchange resins of the present invention, which have the unique construction described above, make it possible for the first time to produce papers composed of a ion exchange fiber. Such a ion exchange paper can be prepared from an ion exchange fiber alone as well as from a mixture of two or more ion exchange fibers or of an ion exchange fiber and other inert organic or inorganic paper forming fibers. A powdered ion exchange resin can be compounded in the paper because the fibers of the present invention have many fibrils therein. As the inert fiber for the paper, many kinds of fibers can be used. However, polyolefin and cellulosic pulps are preferable because of their chemical stability and paper forming ability. The suitable content of the inert fiber is 5 to 80% to maintain paper strength.

Furthermore, 1 to 80% of activated carbon, bone black, and/or activated carbon fiber can be blended with the ion exchange fibers to prepare sheets with excellent deodorizing and decoloring capacity. Such a sheet is partcularly useful for improving the quality of water, especially drinking water.

A preferable amount of water retention of the fiber is more than 0.5 (g water/g fiber). The water retention has the following meaning. Namely, if the water content is lower than 1.0, the amount of adsorption of colloidal substances, e.g., proteins such as enzymes, viruses, bacteria, cells, and microorganisms become smaller. On the other hand, the higher water content assures the larger capacity of adsorption, but it also offers the higher fiber swelling and the more difficult handling. Thus, the preferable water retention is 1.0 to 10, more preferably 1.5 to 5.

The water retention is defined by the following formula:

$$\text{Water Retention} = (W - W_0)/W_0$$

wherein,

W: weight of a cation exchange fiber of Na type (or an anion exchange fiber of Cl type) after centrifugation of the fiber, which had been dipped in distilled water, by home laundry machine for 5 minutes.

$W_0$: weight of the fiber brought to absolute dryness.

The fibrous ion change resins of the present invention may be able to be prepared by several methods. For example, the melt spinning is carried out using a islands-in-sea type composite spinneret at a spinning temperature of about 270° C. The fiber is winded up at a spinning speed of about 1000 m/min. The resulting undrawn filament or the filament drawn about 2 to 6 times is used as the fiber base.

These filament are used in the form of fibers, yarns, or fabrics. For a cut-fiber, the fibers are cut in a length of 0.1 to 200 mm, preferably 0.2 to 50 mm. Normally the fibers are cut into equal length. However, the uniformity in the fiber length is not necessary.

In the case of cut fibers, cross-linkages and ion exchange groups are introduced into their sea component. One method to introduce these groups, though there are several other optional methods, is as follows: When the sea component is a polystyrene type polymer, the fiber is treated with a formaldehyde source in the presence of an acid catalyst. Thus, a cross-linking group of —CHR— (where R is hydrogen atom or an alkyl group) is introduced. Subsequently, there can be introduced a strongly acidic cation exchange group by sufonation, a medially acidic cation exchange group by phosphonation, or a weakly or a strongly basic anion exchange group by amination or quaternary ammoniation following chloromethylation, respectively.

Cross-linkages and acylaminomethyl groups are also introduced by treatment of the fiber with a formaldehyde source and acylaminomethylating agent in the presence of both an acid catalyst and a swelling agent. In the subsequent step, the acylaminomethyl groups are converted to an aminomethyl group on hydrolysis in the presence of an acid or basic catalyst and then treatment with monochloroacetic acid is carried out to give rise the chelating groups of aminodiacetic acid group.

In order to fibrillate or split at least partially the ion exchange fiber (cut-fiber) thus obtained, the fibers are treated mechanically by subjecting them to a stirrer such as a mixer or a beating machine. For example, this can be achieved by the following mixer treatment. A mixer for common use can be used for fibrillating and splitting. The mixing time by the mixer is usually 0.1 to 20 minutes at 1,000 to 100,000 rpm, preferably 1 to 5 minutes. The mixing time and the number of revolutions of the stirring blade may be selected according to the degree of splitting or fibrillation of the fiber.

Ion exchange sheets, such as a paper, can be obtained by dispersing a fiber of the present invention having a ion exchange function or its mixture with other components, followed by suction filtration, pressing, and heat drying.

The fibrous ion exchange resins thus obtained according to the present inventions are featured by the following advantages. The fibers exhibit excellent ion exchange and adsorption capabilities. The fibers have a large specific surface area and a fine fiber structure as well as a desirable strength and flexibility. Therefore, the fibers can be easily shaped into any shapes suitable for any form of a tobacco filter. The fibers can adsorb or remove not only nicotine and tar, but also selectively remove mutagenic components of tobacco smoke, which are not significantly removed by conventional tobacco filters. The fibers do not give rise any serious problems due to pressure drop during smoking.

Reasonable removal of toxic components of tobacco smoke can be achieved by including one of the fibrous ion exchange resins of the present invention as at least one part of the tobacco filter construction. Namely, in order to improve the performance further, it is preferable that the ion exchange fibers are used in combination with other filter materials to construct a filter.

Unlike activated carbon grains or ion exchange resin particles, the ion exchange fibers of the present invention are able to be easily mixed uniformly with cellulose type fibers and also to be subjected to paper making by itself. Thus, the present invention makes it possible to prepare filters of a uniform and reproducible quality in a commercial scale.

The surface activity is important for the performance of the ion exchange fibers, which is readily deteriorated to a great extent by tar, as is the case of activated carbon. Therefore, it is preferable that tobacco smoke by brought into contact with the fibrous ion exchange resin after having passed through a composition capable of adsorbing its tar components.

From the above considerations, a preferred embodiment contains at least 0.1 milligrams of the fibrous ion exchange resin per gram of tobacco component wherein the ion exchange fiber is combined with a non-ion exchangeable fiber such as a cellulose-type fiber. It is especially preferable that the conventional non-ion exchangeable filter is used to serve a prefilter segment for the ion exchange fiber filter segment. It is also preferable that such a prefilter segment is impregnated with a conventional granular material for tobacco filter, such as a activated carbon. These prefilters can trap at least a certain amount of tobacco tar. The construction in which an ion exchange fiber segment is sandwiched with two filter segments made of a non-ion exchangeable fiber is most preferable.

The tobacco filters prepared according to the present invention effectively reduce the sharp and bitter taste of tobacco smoke. Thus, there is eliminated the unpleasant taste which would be left in the mouth or throat after smoking ordinary filter-fitted tobacco and the resulting mild taste of tobacco or cigarettes would be enjoyable to most smokers.

The fibrous ion exchange resins and the ion exchange sheets of the present invention can be used not only as a material of tobacco filters, but also as ion exchangers and adsorbants with a wide variety of applications. These applications include uses as a filter material for purification of the recycled water at an atomic power plant or other ordinary boiler, as a carrier for retaining fungi, bacteria and other microorganisms for aeration purification of water, and as a carrier for adsorption or desorption of protein such as enzymes, cells such as bacteria, and microorganisms.

Furthermore, the fibers of the present invention can be used as an acid or base catalyst for organic reactions, as a water absorbing agent, and as a carrier which releases an adsorbed chemical at a very slow rate. The paper-like sheets made of the fibers of the present invention can be used as a filter in the field of brewage, food, and drink manufacturing, as a filter for trapping and separating ions or colloids from their dilute solutions, and as a test paper for analysis of blood or used water at an atomic power plant. These sheets are also effective in trapping dust, proteins, viruses, bacteria, cells and microorganisms present in the air when they are used as an air filter.

The present invention will be further described with reference to the following non-limiting examples.

EXAMPLES 1 to 3

A fibrous ion exchange resin was prepared as follows.

A blended compound consisting of 40 parts of polystyrene (styron #679, manufactured by Asahi Dow) and 10 parts of polypropylene (Noblen J3H-G, manufactured by Mitsui Toatsu) was used as the sea component and 50 parts of polypropylene was used as the island component. The melt spinning was carried out using a islands-in-sea type composite spinneret at a spinning temperature of 270° C., which is followed by winding up at a spinning speed of 1000 m/min after the oiling agent treatment. The resulting multi-filament having a 420 denier and 42 filaments was cut to a fiber length of 1.0 mm along the axis of the fiber. The resulting cut-fiber was immersed in a solution for crosslinking consisting of 22 parts of sulfuric acid, 104 parts of nitrobenzene, and 0.3 parts of paraformaldehyde and the reaction was carried out at room temperature for 6 hours. After being washed subsequently with distilled water and methanol and dried, the resulting product was then immersed in sulfuric acid and the sulfonation was carried out at 90° C. for 2 hours. The sulfonated fiber thus obtained was washed with distilled water and dried at room temperature. The product was a strongly acidic cation exchange fiber containing H-type sulfonic acid group and having an ion exchange capacity of 3.0 meq/g-Na and a moisture content of 12.3%.

A portion of the above-mentioned ion exchange fiber was subjected to mixing for 3 minutes with the aid of a mixer (mixer VA-835, manufactured by Hitachi), following the addition of 400 ml of water per one gram (dry weight) of the ion exchange fiber. Microscopic observation confirmed that a large portion of the fiber was fibrillated and split by the treatment described above.

A commercially available filter-attached cigarette of a Japanese brand, "Seven Stars", consists of 1 g of a tobacco leaf segment and a filter, the latter consisting of two separate conventional cellulose acetate filter segments. The two filter seagments were separated by cutting the filter at right angles to its axis and 10 mg of the above-described fibrillated ion exchange fiber (Example 1) or 10 mg of the unfibrillated ion exchange fiber (Example 2) was inserted between the two segments.

In Example 3, a filter consisting of 150 mg of the fibrillated ion exchange fiber of the present invention alone was used in place of the filter of a "Seven Stars" (containing 40 mg of activated carbon of 500 microns in average particle size and 110 mg of cellulose acetate fiber).

The filter-attached cigarettes, "Seven Stars", untreated are used as comparative Example 1.

In comparative Example 2, 10 mg of an ion exchange resin (Amberlite IR-120 G; granular H type sulfonic acid group-containing cation exchange resin having an average particule size of 500 microns, an ion exchange capacity of 4.4 meq/g-Na, and a moisture content of 40.0%) was inserted in the same manner as described for Examples 1 to 2.

The filters were evaluated as follows.

Four cigarettes fitted with one of the filters of various types described above were attached to a glass-made smoking apparatus shown in FIG. 1 and smoked at 100 mmHg by connecting the vent of the apparatus to an aspirator. The suction was carried out for 2 seconds each time at 30-sec intervals and controlled so that the smoking of one cigarette should be completed in 7 minutes and 30 seconds. The trapping portion (A in FIG. 1) was placed in an ice-water bath and cigarette smoke was cooled and condensed therein at 0° C.

After smoking was completed, the resulting smoke condensate and cigarette smoke components trapped by the filter were analyzed. A cigarette smoke condensate trapped in the condenser was dissolved in 3 ml of ethanol. The solution was evaporated to dryness under a reduced pressure using a rotary evaporator. The residue thus obtained was dissolved again in 0.20 ml of ethanol to prepare a specimen for gas chromatographic analysis.

Figure 2:
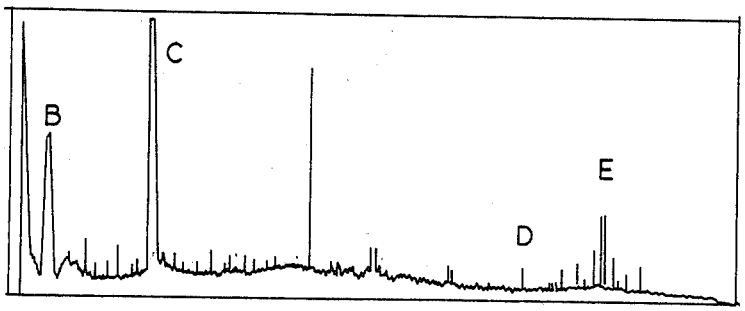
FIG. 2 shows a gas chromatogram of a smoke condensate obtained from conventional filter-attached cigarettes.
Figure 3:
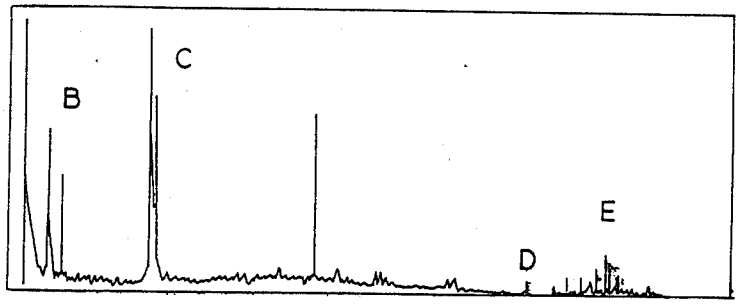
FIG. 3 shows a gas chromatogram of a smoke condensate obtained from cigarettes fitted with a filters of the present invention.

In the gas chromatographic analysis, a Shimazu Model CR-1A gas chromatograph equipped with a 25 m SE-54 silica capillary-column was used. The initial column temperature was 80° C. and the temperature was increased to 280° C. at a rate of 40° C./min (FIGS. 2 and 3).

The filter portion of the cigarette was immersed in 20 ml of ethanol and shaken for 30 minutes to extract the tobacco smoke components trapped by the filter. The resulting ethanolic solution was then filtered. The filter portion was further immersed in a mixture of 20 ml of ethanol and 1 ml of 1N NaOH aqueous solution and shaken for 30 minutes to extract alkali-soluble components.

Figure 4:
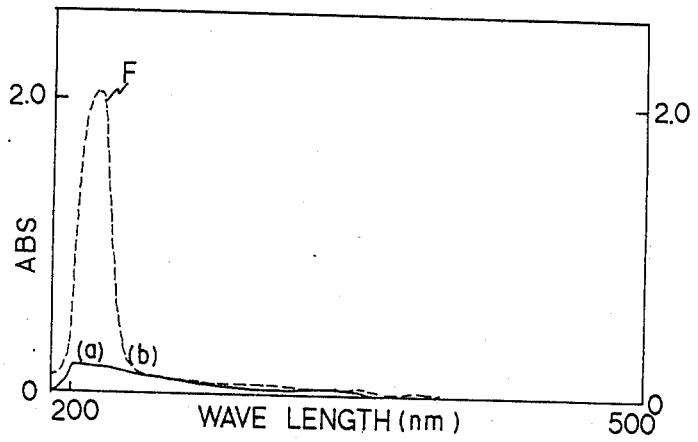
FIG. 4 shows a UV spectrum of the substances adsorbed on particles of an ion exchange resin used in the smoking test.
Figure 5:
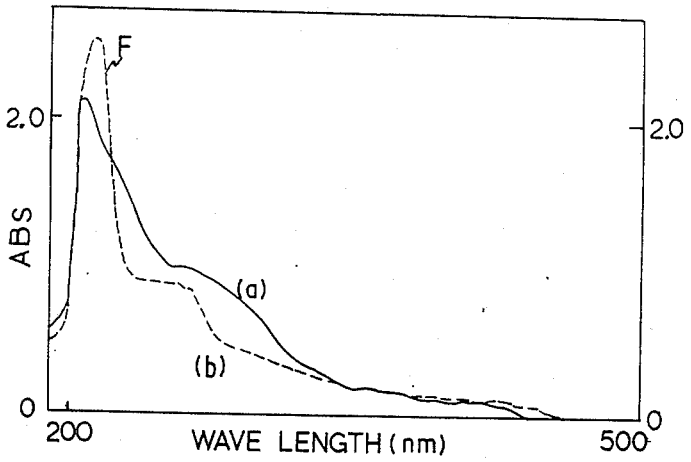
FIGS. 5 and 6 show UV spectra of cigarette smoke components trapped by the filters of the present invention used in the smoking test.
Figure 6:
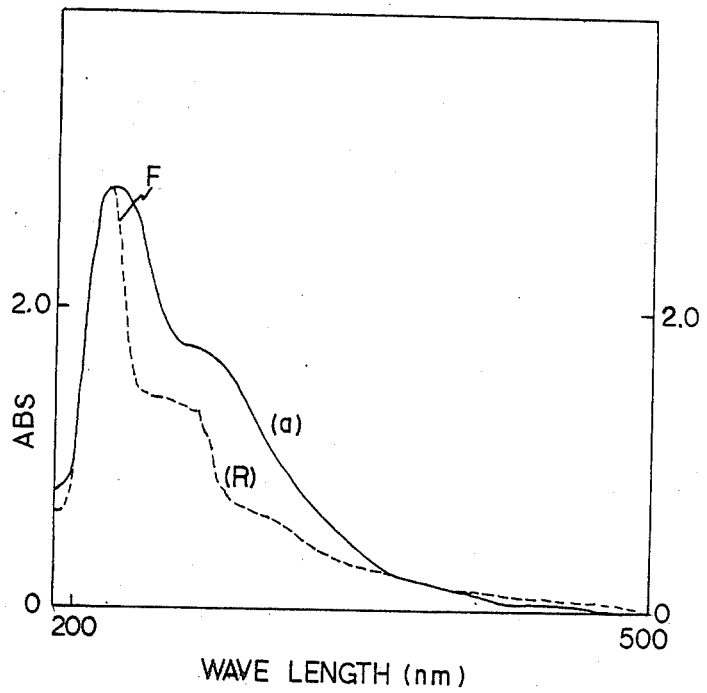
Figure 7:
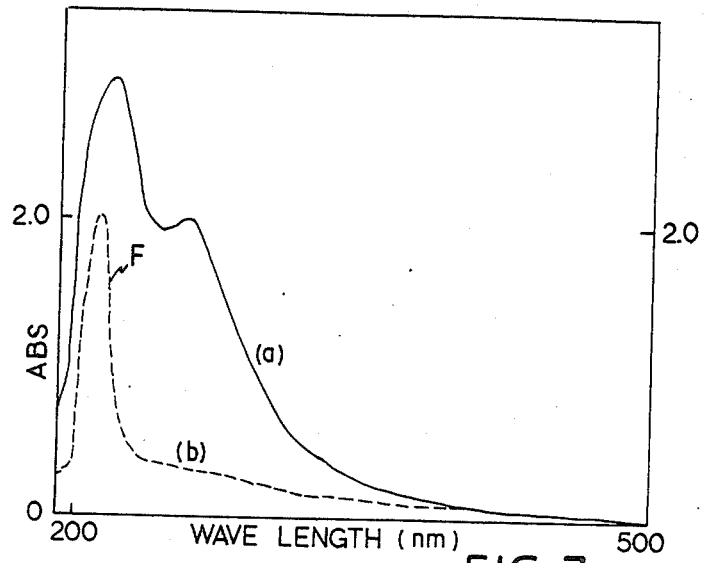
FIGS. 7 and 8 show UV spectra of the substances adsorbed by the overall filter constituents during smoking of a conventional filter-attached tobacco and by a tobacco fitted with the filter made of one of the fibrous ion exchange resins of the present invention alone, respectively.
Figure 8:
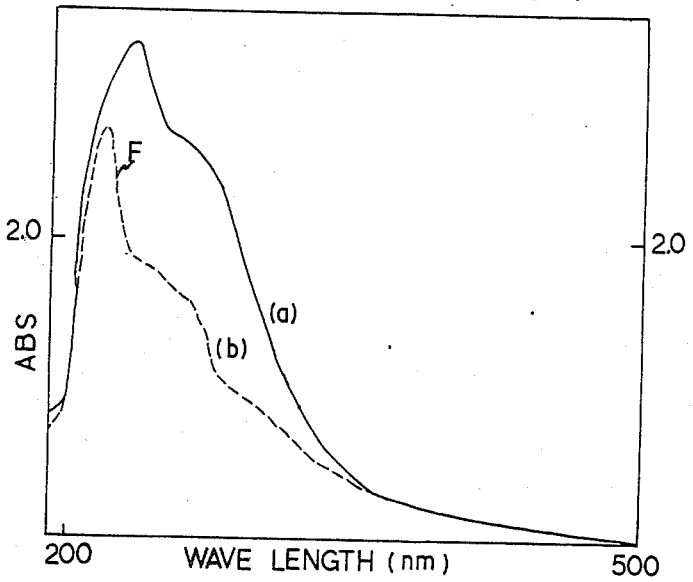

These ethanolic and alkaline ethanol solutions were subjected to UV analysis. In FIGS. 4–8, the solid and broken lines indicate UV-spectra of ethanol-soluble components and of alkaline-soluble components, respectively. UV spectra were recorded using a Shimazu Model-UV-240 spectrophotometer. While FIGS. 4 to 6 show the spectral data of the ethanol and alkaline ethanol extracts obtained when from only the inserted ion exchangers, but not other filter constituents, were immersed for extraction. FIGS. 7 and 8 show the spectral data of these extracts obtained when the whole of the filter constituents was imersed for extraction.

TABLE 1

| Filter | | Data | | |
|---|---|---|---|---|
| Ion exchanger | Inserted amount | UV analysis | Gas chromatography | Remarks |
| Blank | — | FIG. 7 | FIG. 2 | Comparative example 1 |
| (Fibrillated) ion exchange fiber | 10 mg | FIG. 6 | FIG. 3 | Example 1 |
| Ion exchange resin (granular) | 10 mg | FIG. 4 | | Comparative example 2 |
| Ion exchange fiber | 10 mg | FIG. 5 | | Example 2 |
| (Fibrillated) Ion exchange fiber | 150 mg All replaced | FIG. 8 | | Example 3 |

FIGS. 2 and 3 clearly indicate that there is a remarkable difference in the levels of cigarette smoke components in the smoke between commercially available cigarettes, "Seven Stars", with their unmodified filter and those with the filters modified by inserting the ion exchange fiber of the present invention. FIGS. 2 and 3 indicate that both smoke condensates contain components such as nicotine (peak C), boiling point component of 25 carbon atoms (peak D), boiling point component of 32 carbon atoms (peak E) and other many kinds components of tar (base line). The figures also indicate the decreased levels of all cigarette smoke components obtained in Example 1 (FIG. 3), compared to those obtained in comparative Example 1 (FIG. 2). It is especially remarkable that the fibrillated ion exchange fiber of the present invention significantly reduced the levels of cigarette smoke components with boiling point corresponding to compounds of about 10 carbon atoms (peak B) to 25 carbon atoms (peak D) with molecular weights of about 200 to 300, many of which have been shown to be carcinogenic and/or mutagenic.

FIGS. 4 to 6 demonstrate the adsorbing ability exhibited by various types of ion exchangers. FIG. 4, in which peak F is a peak independent from alkali-soluble components, indicates that the granular ion exchange resin used in comparative Example 2 does not significantly adsorb harmful components of cigarette smoke. On the contrary, the ion exchange fibers used in Example 1 (FIG. 6) and Example 2 (FIG. 5) are found to adsorb harmful components of cigarettes smoke to great extents. Especially, the fibrillated ion exchange fiber used in Example 1 demonstrates much more remarkable adsorbing ability of the fibrillated fiber than that of the non-fibrillated ion exchange fiber used in Example 2.

FIGS. 7 and 8 demonstrate the difference in adsorbing ability of the conventional filter used for the cigarettes of the Japanese commercial brand, "Seven Stars", from that of the cigarette filter made of the fibrillated ion exchange fiber alone used in place of the filter of "Seven Stars". These results clearly indicate that the conventional filter of "Seven Stars" (FIG. 7) exhibits very poor ability of adsorbing harmful ionic components of cigarette smoke (broken line), whereas the filter used in Example 3 (FIG. 8) exhibits the highly excellent adsorbing ability.

EXAMPLE 4

Filters containing 0.05, 0.1, 0.5, 1, 10, and 50 mg of the fibrillated cation exchange fiber which was also used in Example 1 were prepared according to the procedures of Example 1 and filters containing 150, 200 and 300 mg of the fibrillated ion exchange fiber according to the procedure of Example 3. These fibers with nine different levels of the fibrillated fibers were compared with the conventional filter for "Seven Stars" in several aspects.

It was found that smoking of a "Seven Stars" with an untreated filter caused mouth irritation and gave rise a feeling of the throat burning by a sharp and bitter taste. On the other hand, in the case of the cigarettes whose filter was modified by compounding the ion exchange fiber, compounding of 0.05 mg of the fiber in the filter produced little difference in the feeling after smoking from the one in the comparative example. However, the 0.1 mg compounding resulted in reduction of irritation left in the mouth. The 0.5 mg compounding reduced the feeling of having burns in the throat. As the compounding amount of the ion exchange fiber was further increased, the sharp taste and bitter taste were further reduced and mildness of the taste was increased. When the compounding amount exceeded 200 mg, however, the taste of tobacco became too diluted and the smoke increasingly insipid.

EXAMPLE 5

Cigarettes of another Japanese commercial brand "PEACE" (long size) were subjected to smoking test as a comparative example. The cation exchange fibers of the same type as the one used in Example 1 with moisture contents ranging from 0% (absolutely dry condition) to 85% (8 levels of 0, 0.5, 1, 2, 30, 50, 80, and 85%) were prepared.

The procedure for moisturization of these fibers was as follows: To the filter sections of cigarettes of "PEACE" (long size), 10 mg of the cation exchange fiber with moisture content of 0% was inserted and moisturized to afford the above mentioned moisture contents.

Smoking of unmodified "PEACE" caused strong throat irritation and their sharp and bitter taste were left in the mouth after smoking. On the other hand, although the ion exchange fiber compounded filter did not significantly reduce the unpleasant taste of the cigarettes when the moisture content of the fiber was 0%, the filter was moderately effective in reducing irritation and in producing a mild and light taste even when the moisture content was 0.5%. As the moisture content was further increased above 1%, mildness and lightness were further increased. However, suction resistance could be detected when the moisture content exceeded 50% and the suction became difficult when it exceeded 80%. Consequently, the highest moisture content of the ion exchange fiber is practically 80% to obtain a good result and the moisture content over 80% is undesirable from a viewpoint of easiness of smoking.

EXAMPLE 6

Figure 9:
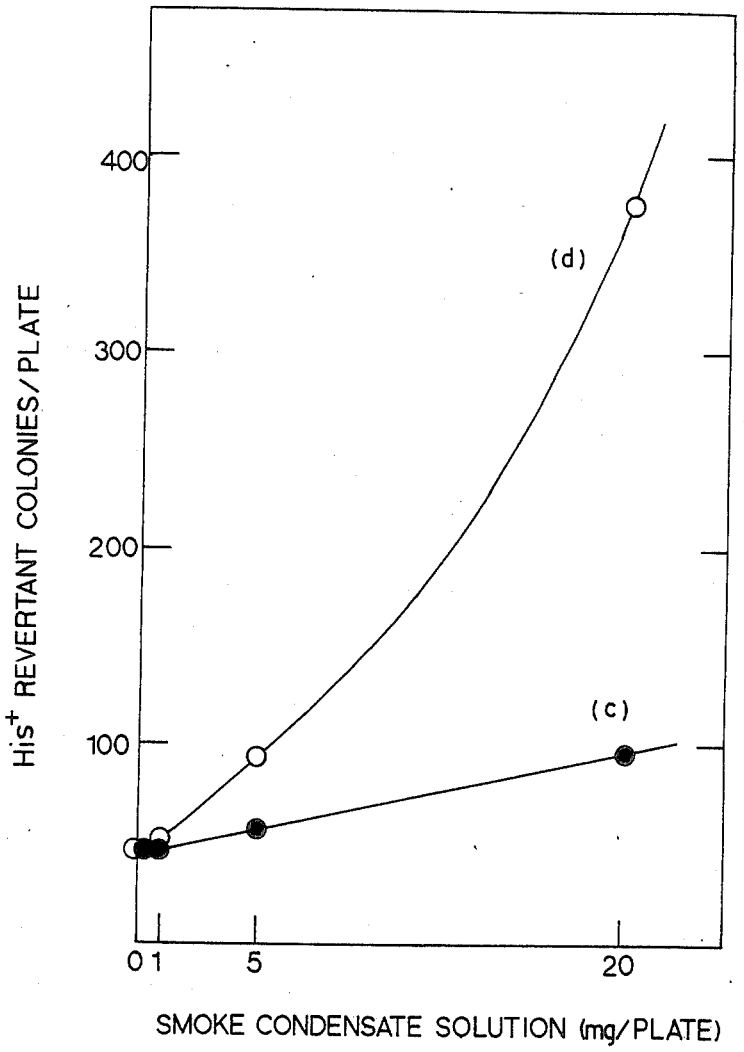
FIG. 9 shows mutagenic activities of a smoke condensate obtained from a conventional filter-attached cigarettes and a smoke condensate from cigarettes fitted with the filters of the present invention.

Using the same apparatus and procedure as the ones described in Example 1, condensates were obtained from 20 cigarettes of commercially available "PEACE" (long size), in the filter of which 10 mg of the fibrous ion exchange resin (cation, H type) described in Example 1 had been inserted. The condensates were dissolved in 10 ml of dimethyl sulfoxide (DMSO) with first reagent grade and subjected to Ames test which was carried out according to the pre-incubation method using salmonella typhimurium TA 98 and PCB-induced S9 mix. The results are shown in FIG. 9. The number of $His^+$-revertant colonies induced by cigarette smoke condensate increased in a dose dependent manner. The numbers of $His^+$-revertant colonies induced by the smoke condensate obtained from cigarettes whose filter was modified by compounding the fibrous ion exchange resin of the present invention are extremely small when compared to those induced by corresponding doses of smoke condensate obtained from the unmodified cigarettes (FIG. 9 (d)). These results indicate that mutagenic activity of a cigarette smoke condensate can be remarkably reduced by using the ion exchange fiber. This is further confirmed by the examination of the mutagenic activity of the cigarette smoke components trapped by the fibrous ion exchange resin.

Figure 10:
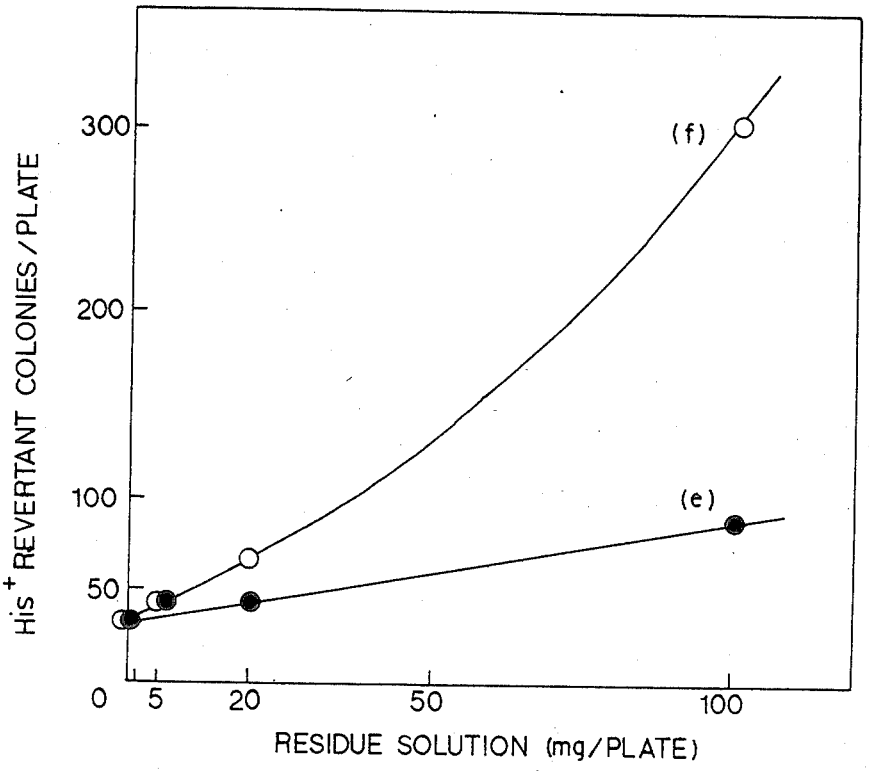
FIGS. 10 and 16 show the mutagenic activity of cigarette smoke components trapped by the tobacco filter of the present invention.
Figure 11:
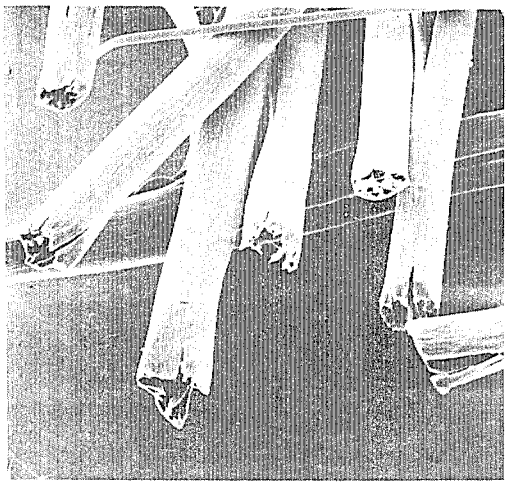
FIG. 11 shows a microphotograph of a conventional ion exchange fiber magnified 200 times.
Figure 12:
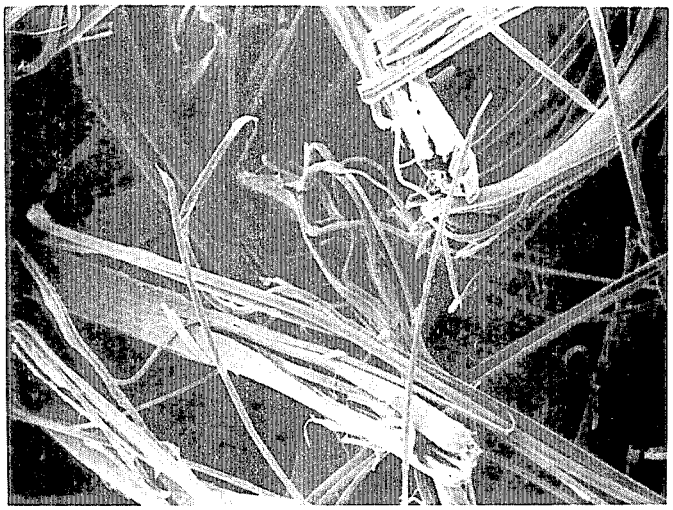
FIG. 12 and 13 show microphotograph of one of the fibrous ion exchange resins of the present invention magnified 200 and 90 times, respectively.
Figure 13:
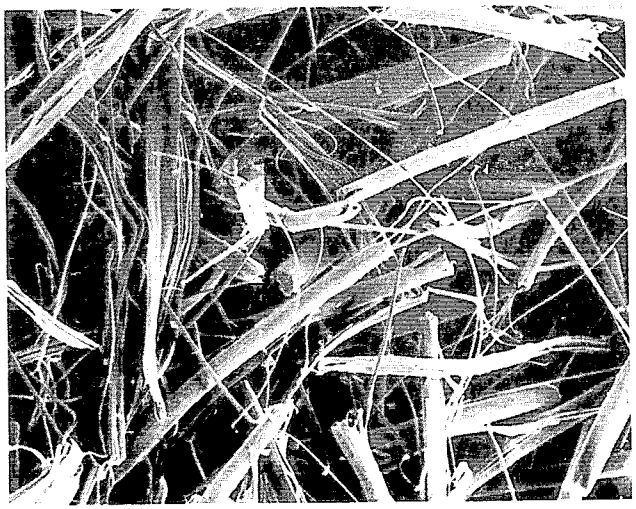

The inserted ion exchange fibers (50 mg) were removed from filters of 5 cigarettes after the above-mentioned smoking test. The fiber was eluted with 40 ml of ethanol and the elute was evaporate under a reduced pressure. The resulting residue (Residue x) was dissolved in 2.5 ml of DMSO and subjected to Ames assay to determine mutagenic activity. Following elution with ethanol, the ion exchange fiber was further eluted with a mixture of 40 ml of ethanol and 2 ml of 1N NaOH. The elute was neutralized with 1N HCl, and evaporated under a reduced pressure. The resulting residue (Residue Y ) was dissolved in 2.5 ml of DMSO- $H_2O$ (1:1) and also subjected to Ames assay. FIG. 10 shows the results of Ames assay for Residues X and Y.

There is a remarkable difference in mutagenicity between Residue X and Y. It is obvious that Residue Y exhibits a very high mutagenic activity compared to Residue X.

EXAMPLE 7

The cut fiber obtained in Example 1 was immersed in the liquid consisting 5 parts of paraformaldehyde, 25 parts of acetic acid, and 70 parts of concentrated sulfuric acid, for crosslinking. The reaction was carried out at 90° C. for 2 hours to insolubilize the sea component of the fiber, polystyrene, by crosslinking. The resulting crosslinked fiber was subsequently reacted at 30° C. for 1 hour with 85 parts of chloromethyl ether in the presence of 15 parts of stannic chloride. Following the reaction, the chloromethylated fiber was washed subsequently with 10% hydrochloric acid, distilled water, and then acetone. The washed fiber was aminated in 30% aqueous trimethylamine at 30° C. for 1 hour. The fiber thus obtained was found to be a strong basic anion exchange fiber with an ion exchange capacity of 2,3 meq/g-Cl and with a water retention of 1.5.

Treatment of the fiber with a mixer as described in Example 1 gives rise a fibrillated fiber of the present invention.

EXAMPLES 8 to 11 and COMPARATIVE EXAMPLE 3

Papers were prepared from the fibrillated or non-fibrillated ion exchange fibers obtained in Example 1 and 7. The compositions of the pulp were as follows:

Example 8: pulp of the ion exchange fiber obtained in Example 1, alone

Example 9: pulp of the ion exchange fiber obtained in Example 7 alone

Example 10: 50/50 mixture of the ion exchange pulps obtained in Examples 1 and 7

Example 11: 70/30 mixture of the ion exchange pulps obtained in Example 1 and polyethylene pulp "SWP" (manufactured by Mitsui Petrochemical Industries, Ltd.)

Comparative Example 3: non-fibrillated ion exchange fiber

Each of pulps having the above-mentioned compositions was dispersed in water and filtered under suction. The resulting sheet was hot pressed and then dried. Thus, papers having a whose weights of 500 g/m$^2$ were prepared. The pulp used in comparative Example 3 is not fibrillated or split and is not readily entangled. The paper prepared in comparative Example 3 was too brittle and has insufficient flexibility for an ordinary paper use. On the contrary, it is easy to prepare papers from all other pulps described above. These pulps are easily mixed each other and, therefore, readily form paper sheets.

Using papers thus obtained, a water flow rate of 940 to 950 l hr.m$^2$ can be attained, indicating the excellence of these papers as filters. For comparison, the water flow rate of commercially available ion exchange powder layer, having the same density of 500 g/m$^2$ is only 10 l hr.m$^2$.

The paper prepared in Example 9 was cut into a circle and packed in a column at a density of 0.1 g/ml to test its adsorbing capacity of living bacteria. Drinking water was passed through the column at a flow rate of SV 50 hr$^{-1}$. Even after its 4-hr use for filtration, the efficiency of the filter is not degraded and the number of living bacteria in the filtered water collected after 4-hr continuous use of the filter was 0 to 1 per 100 ml. The number of bacteria in the drinking water before the filtration was 63/100 ml. Thus, papers made of the ion exchange fibers of the present invention show an excellent capacity to trap bacteria.

EXAMPLE 12

A paper was prepared from a mixture of the fibrillated ion exchange fiber prepared as described in Example 1 and polyethylene pulp (50:50, dry weight basis). The fiber and pulp were dispersed in water and filtered by suction with stirring. The resulting paper-like sheet was hot pressed and then dried. The paper with a density of 200 g/m$^2$ was thus obtained.

A tobacco filter was prepared from 150 mg of the ion exchange paper prepared described above and 20 mg of polyethylene terephthalate fiber with 0.5 d. The filter has a structure shown in FIG. 14-J and applied to a cigarette pipe as shown in FIG. 15.

Using cigarettes of a Japanese commercial brand "PEACE" (long size), the cigarette pipe prepared as described above was tested for its efficiency of making the taste milder and of reducing the levels of mutogenic components in cigarette smoke. The cigarette pipe effectively reduced the sharp taste of cigarettes as well as the irritation due to the smoke components, thus making the taste milder. Smoking cigarettes using the cigarette pipe is smouth and no suction resistance can be detected. The efficiency of the cigarette pipe of the present invention does not significantly change during smoking even 20 cigarettes, exhibiting its excellent durability.

After smoking 20 cigarettes using a cigarette pipe having the filter of the present invention, the filter was removed to examine the cigarette smoke components adsorbed on the filter. The filter was immersed in ethanol (20 ml/smoke components derived from a cigarette) and shaken for 30 min. The extract was filtered. The filter was further extracted with ethanol-aqueous ammonia (20:1, 21 ml/smoke components derived from a cigarette) as described above. These extracts were evaporated under a reduced pressure at 35° C. to dryness using a rotary evaporator. The resulting residues of the ethanol extract and the ethanol-ammonia extract, both of which contain smoke components derived from a cigarette, weighed 3.5 mg and 2.0 mg, respectively. Thus, a sum weight of 5.5 mg of smoke components derived from a cigarette was recovered from the filter.

Each residue was dissolved in DMSO to afford a concentration of 1% and subjected to Ames test according to the pre-incubation method using Salmonella typhimurium TA 98 and PCB-induced rat liver S9 mix.

Figure 16:
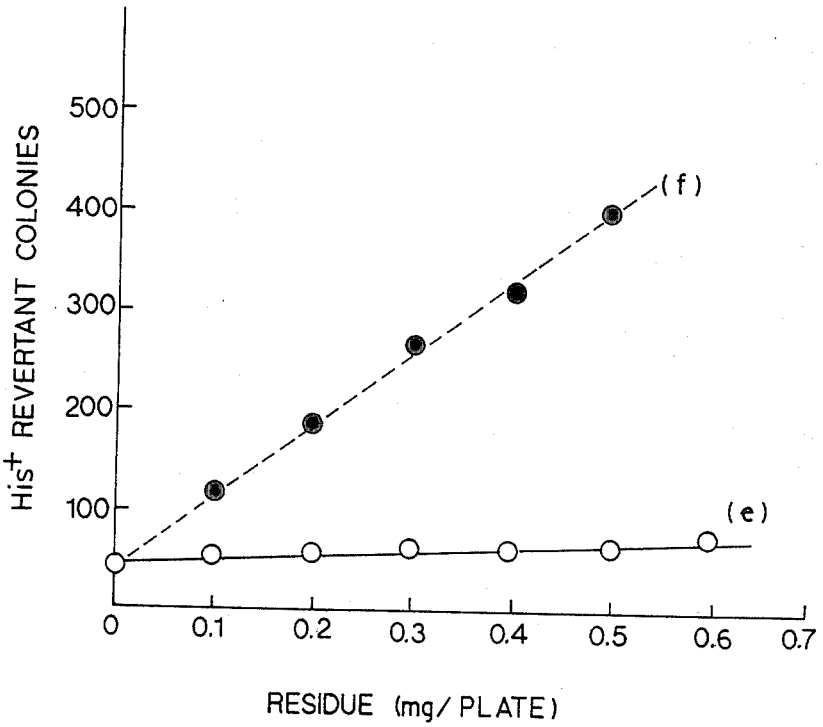

FIG. 16 shows the results of the mutagenicity test, indicating that the ethanol-ammonia extract induced mutation in a dose dependent manner. The alkaline ethanol extract appears to contain cigarette smoke components adsorbed through ion-ion interaction on the ion exchange fiber sheet used in the filter.

On the other hand, the ethanol extract is reasonably assumed to contain cigarette smoke components adsorbed through physical interaction on the sheet and exhibited no significant mutagenic activity.

For comparison, a filter consisting of cellulose acetate fiber alone was examined according to the procedure described for the examination of the filter containing the ion exchange fiber sheet. In this case, smoking gives rise a sharp taste and irritation in the throat. Thus, unpleasant feeling was left long after the smoking. Furthermore, most of smoke components trapped by the cellulose acetate filter can be recovered by extraction with ethanol. Indeed, extraction with ethanol-ammonia did not afford any significant amount of the cigarette smoke components. In addition, the ethanol extract of the cellulose acetate filter did not increase significantly the number of His+-revertant colonies when tested for its mutagenic activity in the Ames assay.

These results indicate that the tobacco filters of the present invention effectively remove and reduce the mutagenic components in tobacco smoke.

We claim:

1. A filter for tobacco smoke which comprises an ion exchange fiber, wherein an ion-exchangeable component itself forms a fibrous structure, the ion-exchangeable component being substantially water-insoluble.

2. A filter as claimed in claim 1, wherein the amount of the ion exchange fiber is not less than 0.1 milligram per 1 g of tobacco being smoked.

3. A filter as claimed in claim 1, wherein the moisture content of the ion exchange fiber is 0.5 to 80%.

4. A filter as claimed in claim 1, wherein the ion exchange fiber is a fiber consisting of a ion exchangeable polymer and a reinforcing polymer.

5. A filter as claimed in claim 4, wherein the ion exchange fiber is an "island-in-sea" type fiber comprising an ion exchangeable sea component and a reinforcing island component.

6. A filter as claimed in claim 1, wherein the ion exchange fiber contains a fiber that is at least partially fibrillated or split.

7. A filter as claimed in claim 1, wherein the ion exchange fiber contains a cation exchange fiber as at least one component.

8. A filter as claimed in claim 7, wherein the cation exchange fiber is a fiber having a sulfonic acid group as the exchange group.

9. A filter as claimed in claim 8, wherein the cation exchange fiber contains a $—SO_3H$ group.

10. A filter as claimed in claim 1, which contains activated carbon as a filter component.

11. A filter as claimed in claim 1, which contains the ion exchange fiber dispersed in other filter components.

12. A filter as claimed in claim 11, wherein one of the other filter components is fibers of cellulose acetate.

13. A filter as claimed in claim 1, wherein a layer containing said ion exchange fiber is inserted perpendicularly to the axis of the filter.

14. A fibrous ion exchange resin of fibrillated or split islands-in-sea construction comprising an ion exchangeable sea component reinforced with an island component.

15. A sheet which contains a fibrous ion exchange resin of fibrillated or split islands-in-sea construction comprising an ion exchangeable sea component reinforced with an island component.

16. A sheet as claimed in claim 15, which contains a pulp.

17. A filter for tobacco smoke, comprising a sheet comprising an ion exchange fiber, wherein an ion-exchangeable component itself forms a fibrous structure, the ion-exchangeable component being substantially water-insoluble, wherein said sheet is arranged in a position parallel to the axis of the filter.

18. A filter claimed as claim 17 having a construction of parallel layers of the ion exchange fiber sheet and a fibrous non-ion exchange layer sheet.

* * * * *